United States Patent [19]

Austin

[11] 4,291,806

[45] Sep. 29, 1981

[54] CARTON WITH VENTING ARRANGEMENT

[75] Inventor: John J. Austin, LeGrange, Ill.

[73] Assignee: Champion International Corporation, Stamford, Conn.

[21] Appl. No.: 113,758

[22] Filed: Jan. 21, 1980

[51] Int. Cl.[3] ..... B43M 7/00; B65D 3/26; B65D 5/54

[52] U.S. Cl. ..... 206/620; 229/17 R; 229/DIG. 14; 229/7 R; 206/611

[58] Field of Search ..... 229/17 R, 52 B, DIG. 14, 229/7 R; 206/611, 620, 621

[56] References Cited

U.S. PATENT DOCUMENTS 3,141,596 7/1964 Murphy ..... 229/17 R 3,149,769 9/1964 Davis ..... 229/17 R 3,161,336 12/1964 Loescher ..... 206/611

3,721,382 3/1973 Cavanagh et al. ..... 229/52 B

*Primary Examiner*—George T. Hall

*Attorney, Agent, or Firm*—Evelyn M. Sommer

[57] ABSTRACT

A venting arrangement in a carton with a top panel and two side panels forms an opening in the carton to facilitate the escape of gas from the interior of the carton. The venting arrangement comprises at least one vent flap defined by two perforated lines and one fold line in a carton panel. The vent flap is separated along the perforated lines and folded about the fold line to move the vent flap out of the plane of carton panel to form the gas relief opening in the carton.

11 Claims, 8 Drawing Figures

CARTON WITH VENTING ARRANGEMENT

BACKGROUND OF THE INVENTION

The present invention relates to a carton having a at least one vent. More particularly, the invention relates to a carton having at least one vent formed by tearing and folding portions of the carton along perforated and fold lines to permit the escape of gas.

In cartons or containers packaging items such as frozen foods, it is highly desirable for the same carton to be used for cooking the food as well as protecting it during shipment and display. When the carton is used for cooking the food contained therein, the carton must be adequately vented to permit such gases as steam and water vapor formed from heating the food to escape from the interior of the carton. If the gases are not permitted to escape, such gases as steam and water vapor may cause the food to become soggy and unappetizing.

For example, if a piece of frozen pizza is contained within the carton and placed within a conventional or microwave oven, the steam or water vapor created during cooking would make the crust of the pizza soggy. This problem is alleviated by providing adequate vents in the carton which may be opened just prior to cooking to permit the escape gases during cooking.

Such vents must remain closed during shipment and display to prevent contamination of the food in the carton and must be easily and simply opened without undue force. Additionally, the construction and location of the vents should not impair the structural integrity of the carton and not damage the food upon opening.

SUMMARY OF THE INVENTION

Accordingly, it is an object of the present invention to provide a venting arrangement for a carton which is simple, quick and inexpensive to operate and manufacture.

Another object of the present invention is to provide a venting arrangement for a carton which will remain closed during shipment and display and will not accidentally open.

A further object of the present invention is to provide a venting arrangement for a carton which will not damage the contents of the carton upon opening and will not impair the structural integrity of the carton.

The foregoing objects are attained in a carton including a top panel and first and second adjacent side panels hingedly coupled along fold lines, the improvement comprising venting means formed in the panels for opening the carton to facilitate the escape of gas from the interior of the carton comprising a first perforated line extending along a portion of a fold line hingedly coupling two of the panels, a second perforated line formed in one of the two panels and extending at one end from one end of the first perforated line, a first fold line joining the other two ends of the first and second perforated lines, and a vent flap defined in the one panel by the first and second perforated lines and the first fold line, which vent flap may be pivoted about the first fold line out of a plane containing the one panel after separation of the vent flap from the remainder of the one panel upon tearing of the first and second perforated lines.

By forming the venting means for the carton of the present invention in this manner, a carton may be adequately vented, when desired, by tearing the carton along the perforated lines and folding the vent flap about its fold line out of the plane of the panel in which it is formed to provide an opening in the carton. Additionally, the vents are so located and arranged so as not to impair the structural integrity of the carton either in its open or closed position and so as not to damage the food contents upon opening of the vents or during shipment and display.

Other objects, advantages and salient features of the present invention will become apparent from the following detailed description, which taken in conjunction with the annexed drawings, discloses preferred embodiments of the present invention.

As used in the application, the terms "top", or "side", and "bottom" are intended to facilitate the description of the carton. Thus, such terms are merely illustrative of the carton and are not intended to limit the carton to any specific orientation.

As used herein, the term "gas" means all gaseous substances including water vapor and steam. The term "carton" covers any configuration of the carton including the blank and any partially assembled or collapsed form thereof.

BRIEF DESCRIPTION OF THE DRAWINGS

Referring to the drawings which form a part of this original disclosure.

DETAILED DESCRIPTION OF THE PREFERRED EMBODIMENTS OF THE INVENTION

Figure 1:
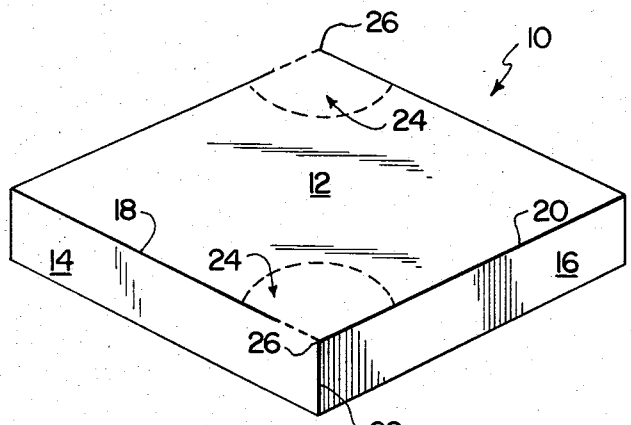
FIG. 1 is a perspective view illustrating a carton according to one embodiment of the present invention.

Referring initially to FIGS. 1-4, the carton 10 is in the form of a hollow parallelopiped having six planar sides with a top panel 12, four side panels 14, 16 (only two of which are illustrated), and a bottom panel (not illustrated). The panels are rectangular and are hingedly coupled along respective fold lines. The carton may be formed of any suitable foldable paperboard, depending upon the size, weight and nature of the item or items to be contained within the carton 10.

Fold lines 18, 20, 22 hingedly couple the top panel 12 to the first side panel 14, the top panel 12 to the second side panel 16, and the first side panel 14 to the second side panel 16, respectively. The carton 10 may be formed in any suitable manner and may include folding and/or tear panels to facilitate sealing and opening.

In the embodiment of FIGS. 1-4, the two venting arrangements 24 are formed in opposite corners 26 of the top panel 12. The corners 26 form the juncture of two side panels and the top panel.

Figure 2:
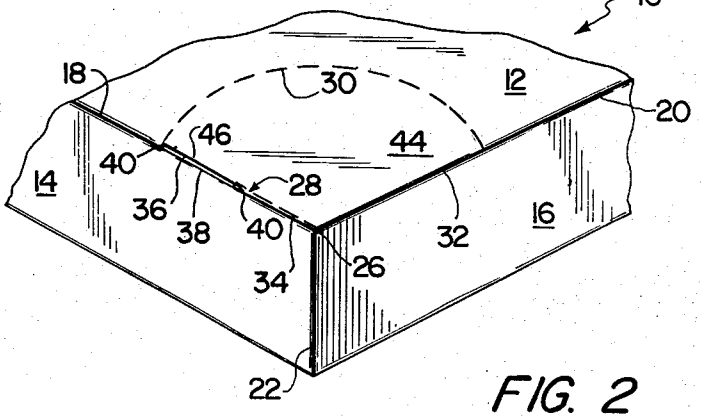
FIG. 2 is an enlarged, partial perspective view of the carton of FIG. 1 illustrating the venting arrangement in a closed position.

As shown in detail in FIG. 2, each venting arrangement 24 comprises a first perforated line 28, a second perforated line 30 and a first fold line 32. Since each of the venting arrangements 24 is identical, only one will be described in detail.

The first perforated line 28 is formed along the fold line 18 between the top panel 12 and the first side panel 14. One-half of the first perforated line 28 comprises a series 34 of perforations formed in the fold line 18. The series 34 extends from the corner 26 approximately half the length of the first perforated line 28. The second half of the perforated line 28 comprises a slit 36 cut into the material of the carton 10 and is defined by a bottom edge 38 and two side edges 40. The bottom edge 38 is located below the series 34. The slit 36 extends between the end of the series 34 and the second perforated line 30.

The second perforated line 30 is arcuate and comprises a series of perforations arranged along a 90° arc having corner 26 as the center of curvature. The second perforated line 30 is formed in the top panel 12 and extends from the end of the first perforated line 28 remote from the corner 26.

The first fold line 32 constitutes the end portion of the fold line 20 located adjacent the corner 26. The first fold line 32 joins the first perforated line 28 at the corner 26 and the second perforated line 30 at the end thereof remote from the first perforated line 28.

The portion of the top panel 12 enclosed by first perforated line 28, the second perforated line 30 and the first fold line 32 defines a vent flap 44. The vent flap 44 is in the shape of a sector having a 90° inclined angle. The vent flap 44 has a gripping tab 46 which extends over the slit 36 and forms the top edge thereof. The gripping tab 46 is formed by the portion of the carton which is cut out by the edges 38, 40 to form the slit 36. As will be explained in more detail later, the gripping tab 46 facilitates the opening of the vent arrangement 24.

During shipment and display of the carton 10, the venting arrangement 24 is in the closed position illustrated in FIG. 2. The venting arrangement 24 is opened just before placing the carton 10 within a conventional or microwave oven.

Figure 3:
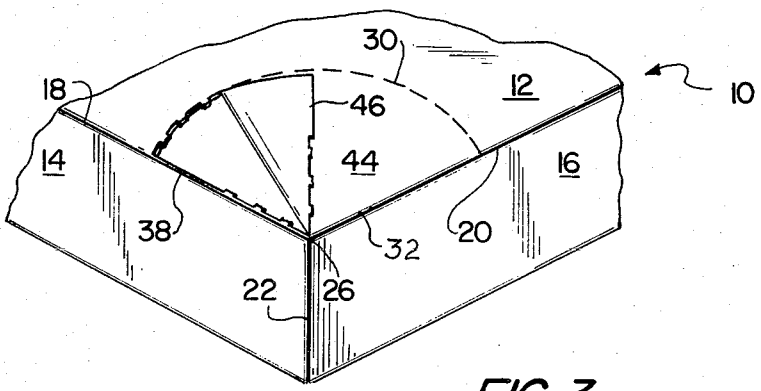
FIG. 3 is an enlarged, partial perspective view of the carton of FIG. 1 illustrating the venting arrangement in a partially open position.
Figure 4:
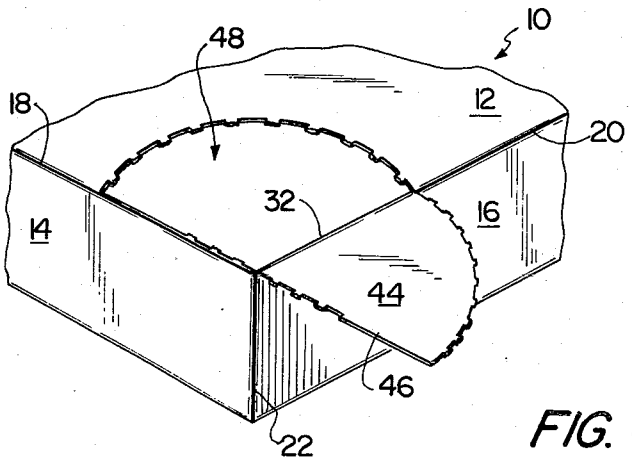
FIG. 4 is an enlarged, partial perspective view of the carton of FIG. 1 illustrating the venting arrangement in a fully opened position.

The carton 10 may be opened by placing a fingernail within the slit 36 and gripping the opposite surfaces of the gripping tab 46. Once the tab 46 has been securely gripped, the vent flap 44 is lifted by tearing the vent flap 44 from the remainder of the top panel 12 along the perforated lines 34, 30 as illustrated in FIG. 3. The vent tab 44 is then pivoted about the first fold line 32 upwardly and out of the plane of the top panel 12 to provide an opening 48 in the top panel 12 as illustrated in FIG. 4. The opening 48 permits gas to escape from the interior of the carton during cooking.

Referring now to FIGS. 5-8, a second embodiment of the present invention is illustrated. In this embodiment, the venting arrangements 52 are formed at opposed side edges of the top panel 12 between the corners thereof. The features of the carton 50 which are identical to those of carton 10 of FIGS. 1-4 are denoted with like reference numerals. Accordingly, those portions will not be discussed further. Since each of the venting arrangements 52 are identical, only one will be described in detail.

The venting arrangement 52 comprises four perforated lines 54, 56, 58, 60 and four fold lines 62, 64, 66, 68. These perforated lines and fold lines define four triangularly shaped vent flaps 70, 72, 74, 76. The first and third perforated lines 54,58 are colinear and are formed in the fold line 18 between the top panel 12 and the first side panel 14. The second and fourth perforated lines 56, 60 are perpendicular to the first and third perforated lines 54 and extend in the panels 12, 14, respectively. The perforated lines 54, 56, 58, 60 meet at and radiate from a common juncture 78 on the fold line 18 and are each equal in length.

Similarly, each of the fold lines 62, 64, 66, 68 are equal in length. The first fold line 62 joins the free ends of the first perforated line 54 and the second perforated line 56. The second fold line 64 joins the free ends of the second perforated line 56 and the third perforated line 58. The third fold line 66 joins the free ends of the third perforated line 58 and the fourth perforated line 60. The fourth fold line 68 joins the free ends of the fourth perforated line 60 and the first perforated line 54.

The venting arrangement 52 spans the juncture of the panel 12, 14 in that the first and second vent flaps 70, 72, the fold lines 62, 64 and the perforated line 56 are located in the top panel 12 while the third and fourth vent flaps 74, 76, the fold lines 66, 68 and the perforated line 60 are formed in the side panel 14. As noted above, the perforated lines 54, 58 are located along the juncture line of the top panel 12 and the side panel 14.

Figure 7:
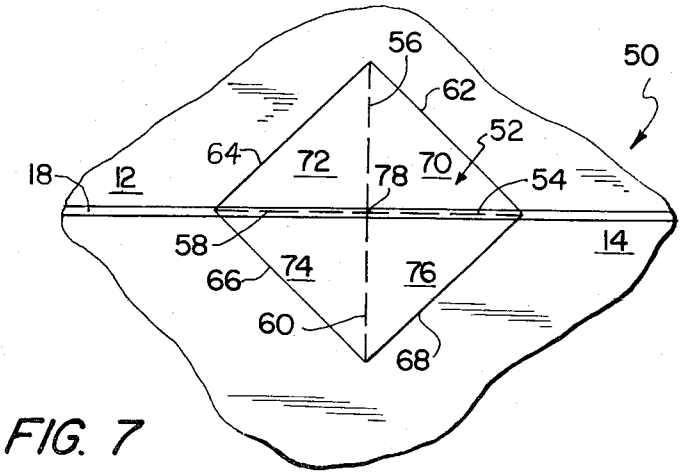
FIG. 7 is an enlarged, partial top plan view illustrating the part of the carton blank forming the venting arrangement of FIG. 5.

As illustrated in FIG. 7, when the venting arrangement 52 is formed in the carton blank, the fold lines 62, 64, 66, 68 form a square or diamond shape with equal sides and 90° included angles. The first and third perforated lines 54, 58 form a first diagonal and the second and fourth perforated lines 56, 60 form a second diagonal across the square formed by the fold lines 62, 64, 66, 68.

Figure 6:
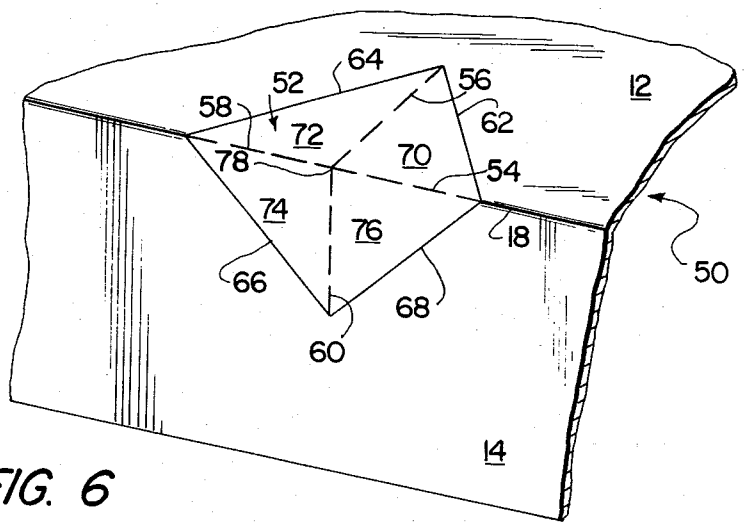
FIG. 6 is an enlarged, partial perspective view of the carton of FIG. 5 illustrating the venting arrangement in a closed position.
Figure 8:
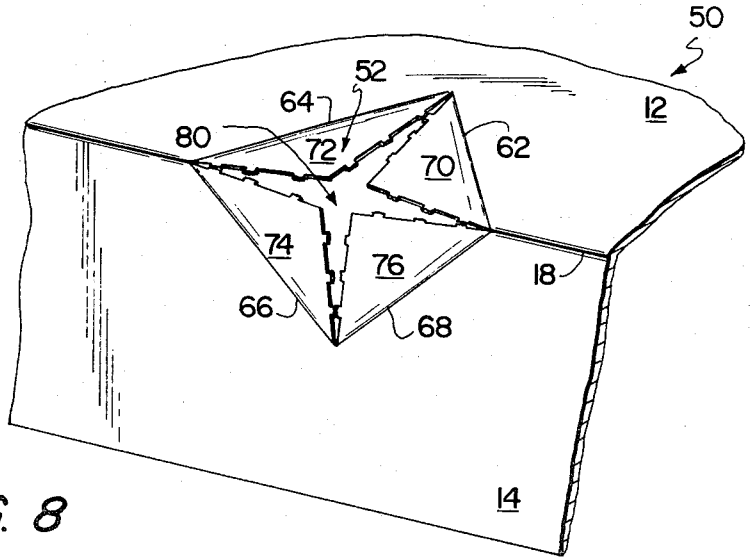
FIG. 8 is an enlarged, partial perspective view of the carton of FIG. 5 illustrating the venting arrangement in an open position.
Figure 5:
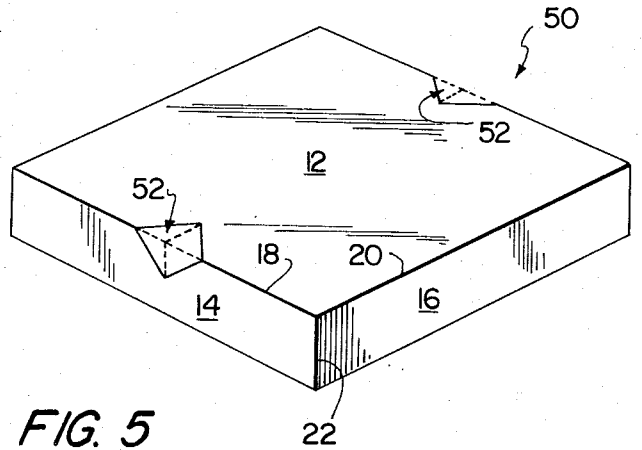
FIG. 5 is a perspective view of a carton according to a second embodiment of the present invention.

In the closed position of the venting arrangement 52 illustrated in FIG. 6, the vent flaps 70, 72 are coplanar with the top panel 12 and the vent flaps 74, 76 are coplanar with the side panel 14. In this position, the perforated lines 54, 56, 58, 60 are intact. To open the vent 52, downward and inward pressure is exerted on the juncture 78 of the perforated lines 54, 56, 58, 60. This pressure forces the perforated lines 54, 56, 58, 60 to tear, thereby separating the vent flaps 70, 72, 74, 76 from each other. The vent flaps 70, 72, 74, 76 then pivot downwardly and inwardly about the fold lines 62, 64, 66, 68, respectively to form an opening 80 in the carton 50. The opening 80 is formed just prior to placement of the carton 50 within a conventional or microwave oven in order to cook the contents of the carton 50.

While particular embodiments have been chosen to illustrate the invention, it will be understood by those skilled in this art that various changes and modifications can be made therein without departing from the scope of the invention as defined in the appended claims.

What is claimed is:

1. In a carton including a top panel and first and second adjacent side panels hingedly coupled along fold lines, the improvement comprising:

venting means formed in said panels for opening the carton to facilitate the escape of gas from the interior of the carton, comprising a first perforated line extending along a portion of a fold line hingedly coupling two of said panels, a second perforated line formed in one of said two panels and extending at one end from one end of said first perforated line, a first fold line joining the other two ends of said first and second perforated lines, and a vent flap defined in said one panel by said first and second perforated lines and said first fold line, which vent flap may be pivoted about said first fold line out of a plane containing said one panel after separation of said vent flap from the remainder of said one panel upon tearing of said first and second perforated lines.

2. In a carton according to claim 1, wherein said venting means is located adjacent the juncture of said top panel and said first and second side panels;

said first fold line extends along a portion of the fold line hingedly coupling said second side panel to said top panel; and said first perforated line extends along a portion of the fold line hingedly coupling said first side panel to said top panel.

3. In a carton according to claim 2, wherein said first fold line and said first perforated line are substantially equal in length.

4. In a carton according to claim 3, wherein said second perforated line is arcuate.

5. In a carton according to claim 2, wherein said first perforated line has a slit adjacent said second perforated line, and said vent flap has a gripping tab defining an edge of said slit.

6. In a carton according to claim 1, wherein said venting means is located at the juncture of said top panel and said first panel; and further comprises third and fourth perforated lines extending from said first and second perforated lines, respectively, at joined ends thereof, second, third and fourth fold lines interconnecting the other ends of said second and third perforated lines, said third and fourth perforated lines, and said fourth and first perforated lines, respectively, and second, third and fourth vent flaps, said second vent flap bounded by said second and third perforated lines and said second fold line, said third vent flap bounded by said third and fourth perforated lines and said third fold line, and said fourth vent flap bounded by said fourth and first perforated lines and said fourth fold line.

7. In a carton according to claim 6, wherein said first and third fold lines are substantially perpendicular to said second and fourth fold lines.

8. In a carton according to claim 6, wherein said first, second, third and fourth perforated lines are equal in length and said first, second, third and fourth fold lines are equal in length.

9. In a carton according to claim 6, wherein said first and second vent flaps are located in said top panel and said third and fourth vent flaps are located in said first side panel.

10. In a carton according to claim 6, wherein said first and third perforated lines are colinear.

11. In a carton according to claim 1, wherein said venting means further comprises a third perforated fold line extending from one of said first and second perforated lines at joined ends thereof, a second fold line joining the other ends of said third perforated line and said one of said first and second perforated lines, and a second vent flap defined by said third perforated line, said second fold line, and said one of said first and second perforated lines.

* * * * *